US009097071B1

(12) United States Patent
Baryam

(10) Patent No.: US 9,097,071 B1
(45) **Date of Patent: *Aug. 4, 2015**

(54) TONG ARM ASSEMBLY WITH FLOATING JAW

(71) Applicant: SCORPION OIL TOOLS, INC., Houston, TX (US)

(72) Inventor: Jacob Baryam, Houston, TX (US)

(73) Assignee: SCORPION OIL TOOLS, INC., Houston, TX (US)

( * ) Notice: Subject to any disclaimer, the term of this patent is extended or adjusted under 35 U.S.C. 154(b) by 301 days.

This patent is subject to a terminal disclaimer.

(21) Appl. No.: 13/848,020

(22) Filed: Mar. 20, 2013

Related U.S. Application Data

(60) Provisional application No. 61/616,218, filed on Mar. 27, 2012.

(51) Int. Cl.
*E21B 19/16* (2006.01)

(52) U.S. Cl.
CPC ..... *E21B 19/163* (2013.01)

(58) Field of Classification Search
CPC .... B25B 13/50; B25B 13/52; B25B 13/5041; E21B 19/16; E21B 19/161; E21B 19/163; E21B 19/18
USPC ..... 81/57.33, 57.34, 57.35, 57.15, 57.19, 81/57.21, 68
See application file for complete search history.

(56) References Cited

U.S. PATENT DOCUMENTS

| | | | | |
|---|---|---|---|---|
| 2,825,253 | A * | 3/1958 | Brenner | 81/68 |
| 3,880,024 | A * | 4/1975 | Asada | 81/57.34 |
| 4,885,963 | A * | 12/1989 | Nishikawa | 81/57.34 |
| 5,778,742 | A * | 7/1998 | Stuart | 81/57.34 |
| 7,997,166 | B2 * | 8/2011 | Lauzon et al. | 81/57.34 |
| 7,997,167 | B2 * | 8/2011 | Kruse et al. | 81/57.34 |
| 8,601,911 | B1 * | 12/2013 | Baryam | 81/57.34 |

* cited by examiner

*Primary Examiner* — Hadi Shakeri
(74) *Attorney, Agent, or Firm* — Buskop Law Group, PC; Wendy Buskop

(57) ABSTRACT

A tong arm assembly configured to engage a tubular can include an arm frame with a recess, gripping cylinder holes, and a makeup/breakout cylinder hole. A floating jaw can be partially disposed within the recess and securable to the arm frame. The floating jaw can include tong dies attached opposite the recess. A gripping cylinder with a moveable rod can be secured to the arm frame. The gripping cylinder can nest adjacent to the arm frame and extend along the arm frame. A counter gripping member can be connected to the moveable rod. Opposite tong dies can be on the counter gripping member. A multi-function L-link assembly can engage the counter gripping member and the arm frame.

12 Claims, 10 Drawing Sheets

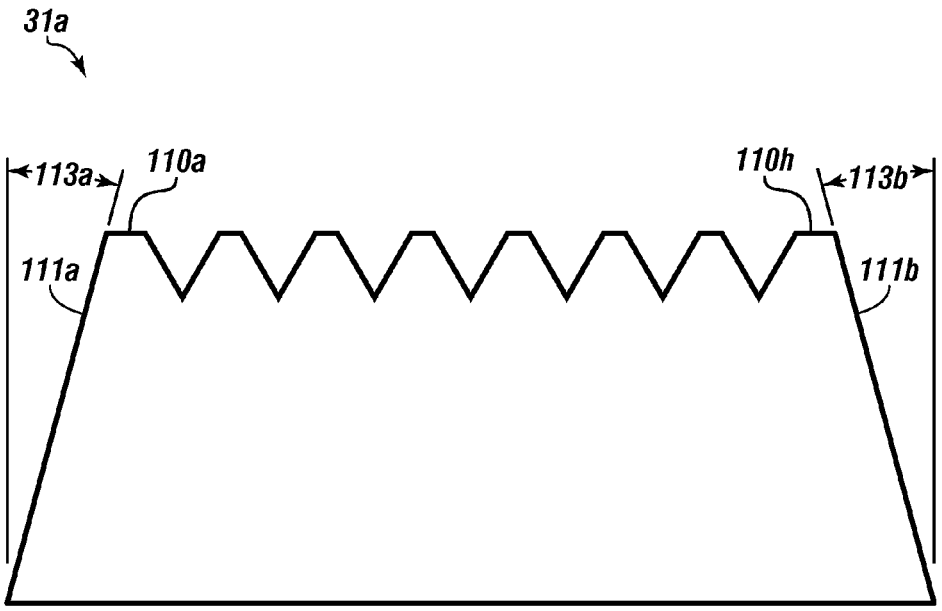
FIGURE 8
FIGURE 9
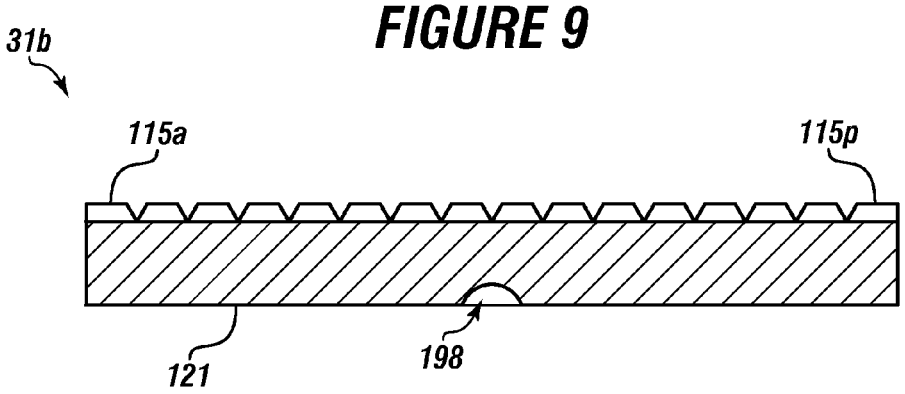

TONG ARM ASSEMBLY WITH FLOATING JAW

CROSS REFERENCE TO RELATED APPLICATIONS

The present application claims priority to and the benefit of U.S. Provisional Patent Application Ser. No. 61/616,218 filed on Mar. 27, 2012, entitled "TONG ARM ASSEMBLY WITH FLOATING JAW". This reference is hereby incorporated in its entirety.

FIELD

The present embodiments generally relate to a tong arm assembly for use in a tong assembly that makes up or breaks out a tubular used in a wellbore, wherein the tong arm assembly has a sturdy and reliable floating jaw assembly.

BACKGROUND

A need exists for a tong arm assembly for making up or breaking out a tubular that can be used with limited training or expertise.

A further need exists for a tong arm assembly that can be used to automatically breakout or makeup tubulars with minimal risk and minimal human interaction.

A further need exists for a tong arm assembly that does not require readjustment during the makeup or breakout procedure due to rolling off center of the tubular when the floating jaw connects with the tubular.

The present embodiments meet these needs.

BRIEF DESCRIPTION OF THE DRAWINGS

The detailed description will be better understood in conjunction with the accompanying drawings as follows:

FIG. 8 depicts a detailed cross sectional view a tong die with teeth usable on the floating jaw, movable jaw, or both.

FIG. 9 depicts a detailed cross sectional view of teeth having flat faces that are usable on the floating jaw, moveable jaw, or both.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to tong arm assembly with a makeup and breakout arm, backup arm, or combinations thereof for engaging tubulars.

The tong arm assembly can include a floating jaw, moveable jaw, or combinations thereof.

The tong arm assembly can have at least three different configurations for variable applications.

The tong arm assembly can be hydraulically operated to engage a tubular in one or more embodiments.

The tong arm assembly can include an arm frame with a recess, gripping cylinder hole, and a makeup/breakout cylinder hole.

The tong arm assembly can connect to a makeup/breakout cylinder by fastening to a rod of the makeup/breakout cylinder through the makeup/breakout cylinder hole.

The floating jaw can be partially disposed within the recess and securable to the arm frame. The floating jaw can have at least one tong die slidably and removably attached thereto opposite the recess.

A gripping cylinder with a moveable rod can be attached to the arm frame via a cylinder fastener engaged through the gripping cylinder holes. The gripping cylinder can nest adjacent the arm frame and extend longitudinally along the arm frame.

A counter gripping member can be connected on one end to the moveable rod of the gripping cylinder. At least one opposite tong die can be disposed on the counter gripping member opposite the tong dies of the floating jaw.

A multi-function L-link assembly can engage the counter gripping member and the arm frame. The multi-function L-link assembly can have at least three different configurations for variable applications.

Figure 1:
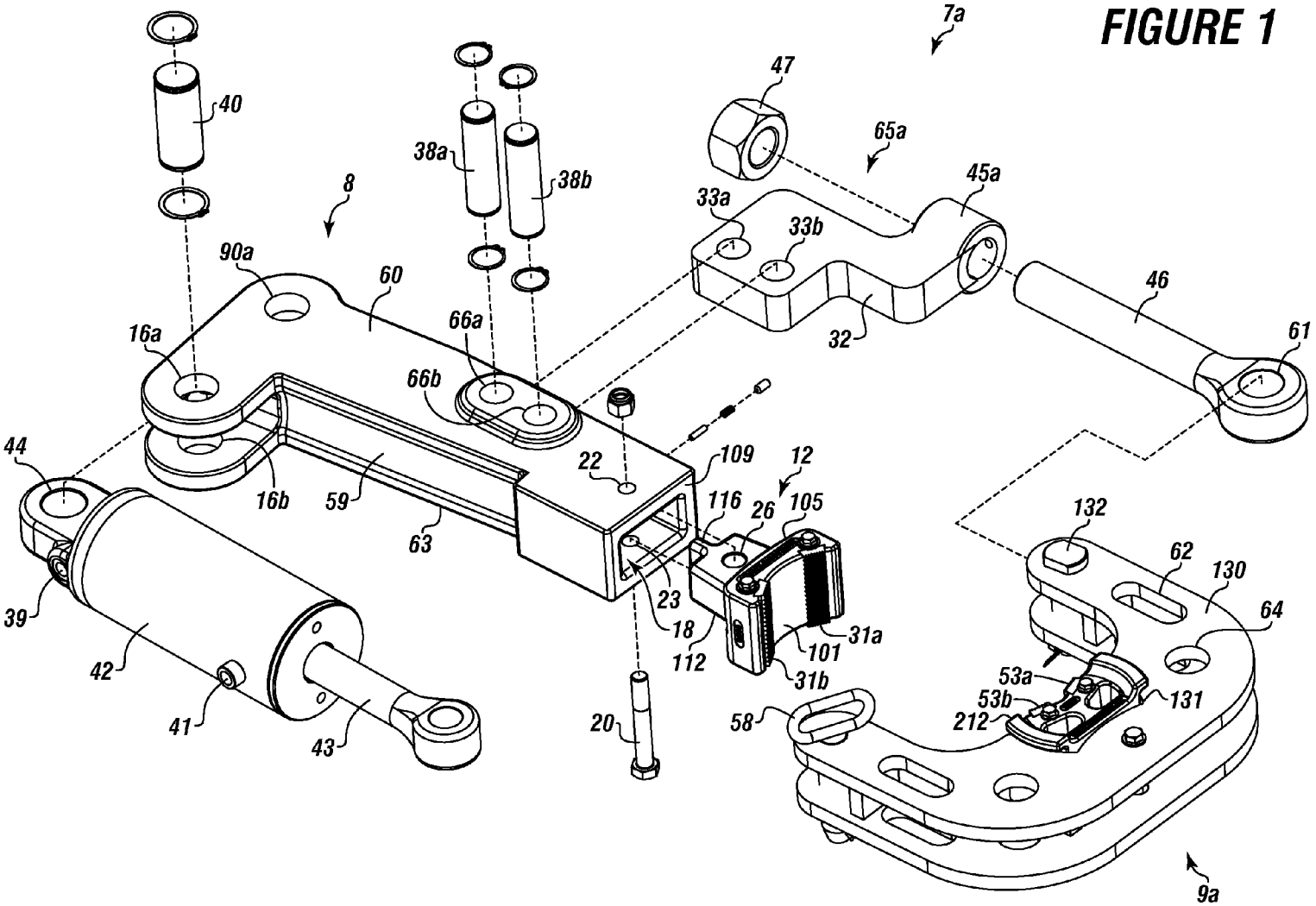
FIG. 1 depicts an exploded perspective view of an embodiment of the tong arm assembly.

Turning now to the Figures, FIG. 1 depicts a tong arm assembly 7*a* configured to engage a tubular, such as a pipe, casing for a well, square tubular used in construction, or other tubular.

The tong arm assembly 7*a* can have an arm frame 8 with a recess 18 and a pair of gripping cylinder holes 16*a* and 16*b*, which can be aligned.

The arm frame 8 can have a pair of makeup/breakout cylinder holes, including makeup/breakout cylinder hole 90*a*, which can be aligned with a makeup/breakout cylinder hole not shown.

The arm frame 8 can include a top plate 60 connected to a bottom plate 63. The top plate 60 and the bottom plate 63 can have the same size and shape.

A side support plate 59 can be connected between the top plate 60 and the bottom plate to provide strength to the arm frame 8.

A floating jaw 12 having a floating jaw tail 112 and floating jaw tail extension 116 can be attached to the arm frame 8. The floating jaw tail 112 and the floating jaw tail extension 116 can be inserted and retained within the recess 18.

The floating jaw tail 112 can be secured to the arm frame 8 with a first fastener 20 through a tail hole 26 in the floating jaw tail 112. The first fastener 20 can pass through a first recess hole 22 in the top plate 60, engage through the tail hole 26, and pass through a second recess hole 23 in the bottom plate 63.

The floating jaw 12 can have a face 101 with tong die grooves formed in the face 101 and tong dies 31*a* and 31*b* slidably and removably attached in the tong die grooves opposite the recess 18. The floating jaw 12 is depicted having two tong dies 31*a* and 31*b*; however, the floating jaw 12 can have more or less than two tong dies.

The floating jaw 12 can have a curved rocking shoulder 105 configured to rest on recess face 109; thereby allowing the floating jaw 12 to rock and float back and forth on the recess face 109.

A gripping cylinder 42 can be attached to the arm frame 8 via a cylinder fastener 40 that can pass through the gripping cylinder hole 16*a*, through a gripping cylinder tail hole 44, and the gripping cylinder hole 16*b*. The gripping cylinder 42 can be fixedly and removably secured to the arm frame 8 via the cylinder fastener 40.

The gripping cylinder 42 can nest adjacent to the arm frame 8 and extend longitudinally along the arm frame 8 from an attaching point.

The gripping cylinder 42 can be hydraulic and connectable to a hydraulic fluid source, not shown, such as through a hydraulic inlet port 39 and a hydraulic outlet port 41.

The gripping cylinder 42 can be hydraulically operated with hydraulic fluid to extend and retract a moveable rod 43 relative to the gripping cylinder 42.

A counter gripping member 9*a* can be connected on one end to the moveable rod 43 and on another end to a multi-function L-link assembly 65*a*.

The counter gripping member 9*a* can have a curved frame 130 with an inner recess 131 positioned directly opposite the floating jaw 12.

A pin tee 58 can be secured through an end of the curved frame 130 opposite an engagement post 132, which can also be secured through the curved frame 130.

The pin tee 58 can simultaneously engage through the curved frame 130 and with the moveable rod 43 to connect the counter gripping member 9*a* with the moveable rod 43.

The engagement post 132 can be removably secured through the curved frame 130 and an eyebolt hole 61 for connecting the counter gripping member 9*a* with the multi-function L-link assembly 65*a* and allowing the curved frame 130 to move against to the multi-function L-link assembly 65*a*.

The counter gripping member 9*a* can include a moveable jaw 212 positioned opposite the floating jaw 12. One or more opposite tong dies 53*a* and 53*b* can be disposed on the moveable jaw 212 the tong dies 31*a* and 31*b* of the floating jaw 12.

The counter gripping member 9*a* can have one or more lifting slots 62, allowing an operator or robot to lift up the counter gripping member 9*a*.

The counter gripping member 9*a* can have one or more storage holes 64 configured to receive the pin tee 58, such as when the pin tee 58 is disconnected from the moveable rod 43.

The multi-function L-link assembly 65*a* can engage the counter gripping member 9*a* on one side and the arm frame 8 on the opposite side.

The multi-function L-link assembly 65*a* can have an L-link body 32 for fixedly engaging the arm frame 8. For example, the link fastening holes 33*a* and 33*b* can be disposed though the L-link body 32. Link attachment holes 66*a* and 66*b* can be formed in the arm frame 8. A link pin 38*a* can be simultaneously secured through the link attachment hole 66*a* and the link fastening hole 33*a*, and a link pin 38*b* can be simultaneously secured through the link attachment hole 66*b* and the link fastening hole 33*b*; thereby securing the multi-function L-link assembly 65*a* to the arm frame 8.

The multi-function L-link assembly 65*a* can have an eyebolt 46, through which the eyebolt hole 61 can be formed.

The eyebolt 46 can extend through a collar 45*a* of the multi-function L-link assembly 65*a*. The eyebolt 46 can engage a nut 47 opposite the eyebolt hole 61 for removably attaching the eyebolt 46 within the collar 45*a*.

In operation, the multi-function L-link assembly 65*a* can cause the counter gripping member 9*a* to slip around a perimeter of a tubular while the moveable rod 43 is in an extended position from the gripping cylinder 42. The tong arm assembly 7*a* can consistently apply torque around the tubular while hydraulically retracting the moveable rod 43 into the gripping cylinder 42.

As the moveable rod 43 retracts into the gripping cylinder 42, the tong dies 31*a* and 31*b* can engage and grip one side of the tubular, while the opposite tong dies 53*a* and 53*b* engage and grip the opposite side of the tubular. The tong dies 31*a* and 31*b* and the opposite tong dies 53*a* and 53*b* can engage and grip the tubular on the outer diameter for making up or breaking out the tubular.

Figure 2A:
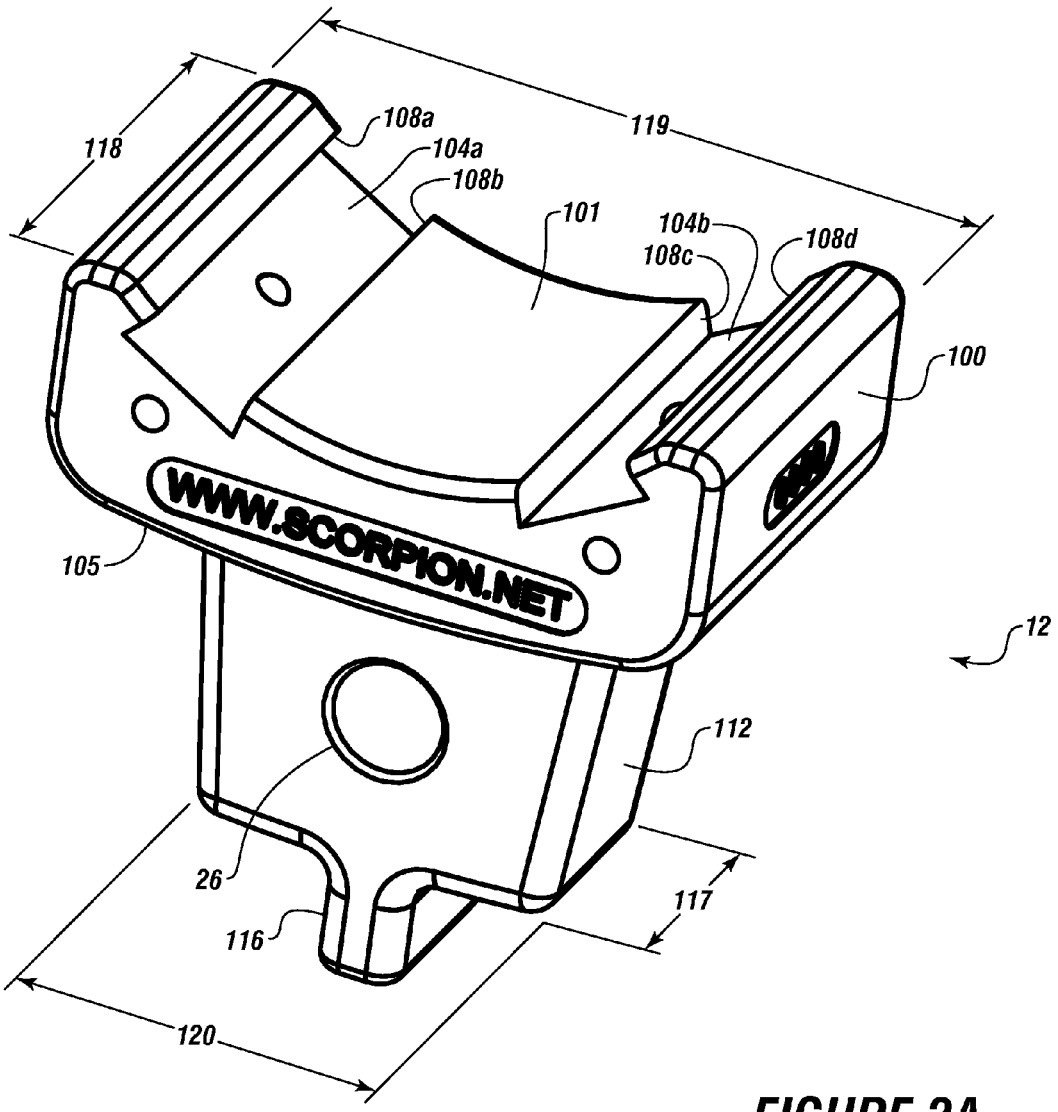
FIG. 2A depicts a detailed perspective view of an embodiment of a floating jaw.
Figure 2B:
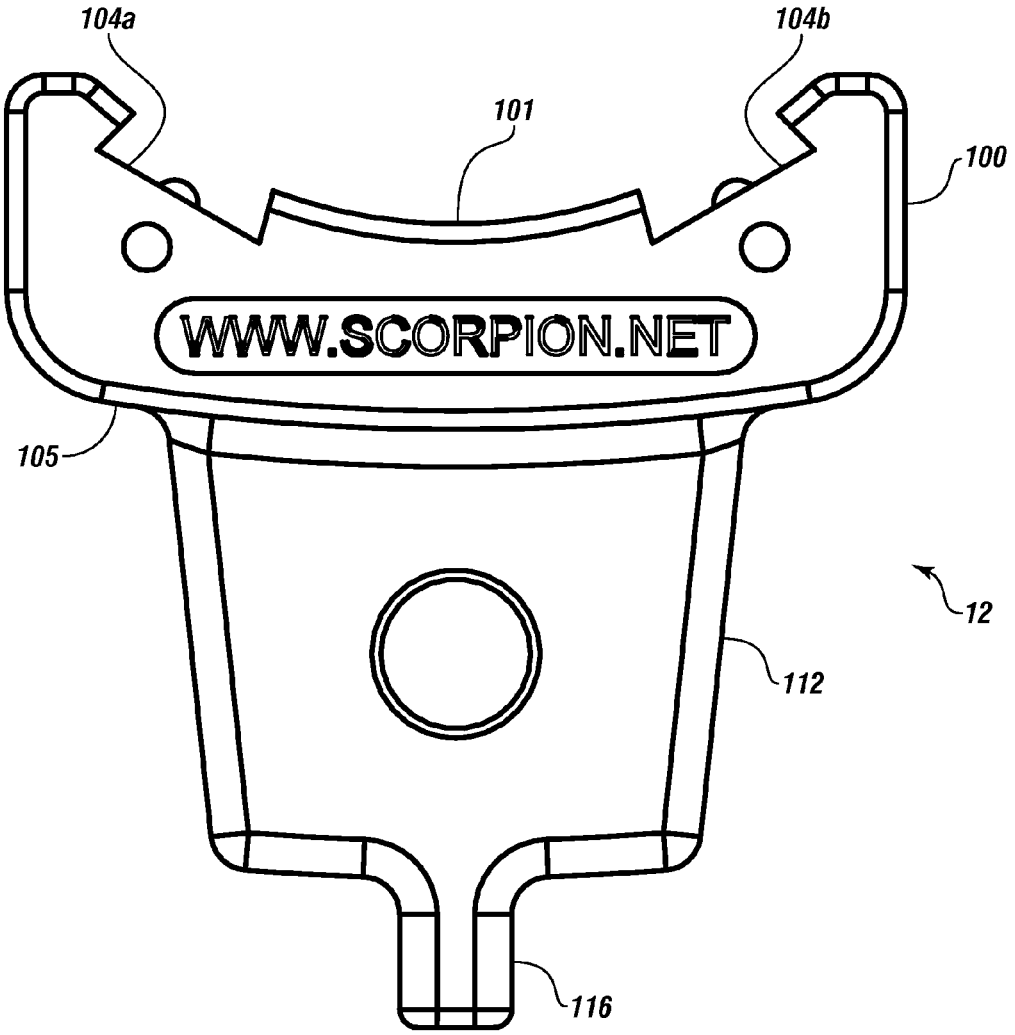
FIG. 2B depicts a cross sectional view of the floating jaw of FIG. 2A.

FIG. 2A depicts a detailed perspective view of an embodiment of the floating jaw, and FIG. 2B depicts a cross sectional view of the floating jaw of FIG. 2A.

The floating jaw 12 can have a floating jaw body 100 having a curved rocking shoulder 105 that allows the floating jaw body 100 to float and rock on the arm frame above the recess with a floating movement.

The floating jaw 12 can have a face 101 formed on a first side of the floating jaw body 100. The face 101 can be disposed opposite the curved rocking shoulder 105.

The face 101 can have one or more tong die grooves, such as two parallel floating jaw tong die grooves 104*a* and 104*b*.

Each parallel floating jaw tong die groove 104*a* and 104*b* can have a pair of sloped groove edges. For example, parallel floating jaw tong die groove 104*a* can have sloped groove edges 108*a* and 108*b*, and the parallel floating jaw tong die groove 104*b* can have sloped groove edges 108*c* and 108*d*.

The floating jaw 12 can have the floating jaw tail 112, which can be integral with the floating jaw body 100, and can extend from the floating jaw body 100 opposite the face 101.

The floating jaw tail 112 can have the tail hole 26 disposed therethrough.

The floating jaw tail extension 116 can be connected with the floating jaw tail 112 and can extend therefrom. The floating jaw body 100, floating jaw tail 112, and floating jaw tail extension 116 can be a one-piece integral structure.

The floating jaw 12 can have a floating jaw body width 118, which can be larger than a floating tail width 117.

The floating jaw 12 can have a floating jaw body length 119, which can be larger than a floating tail length 120.

Figure 3:
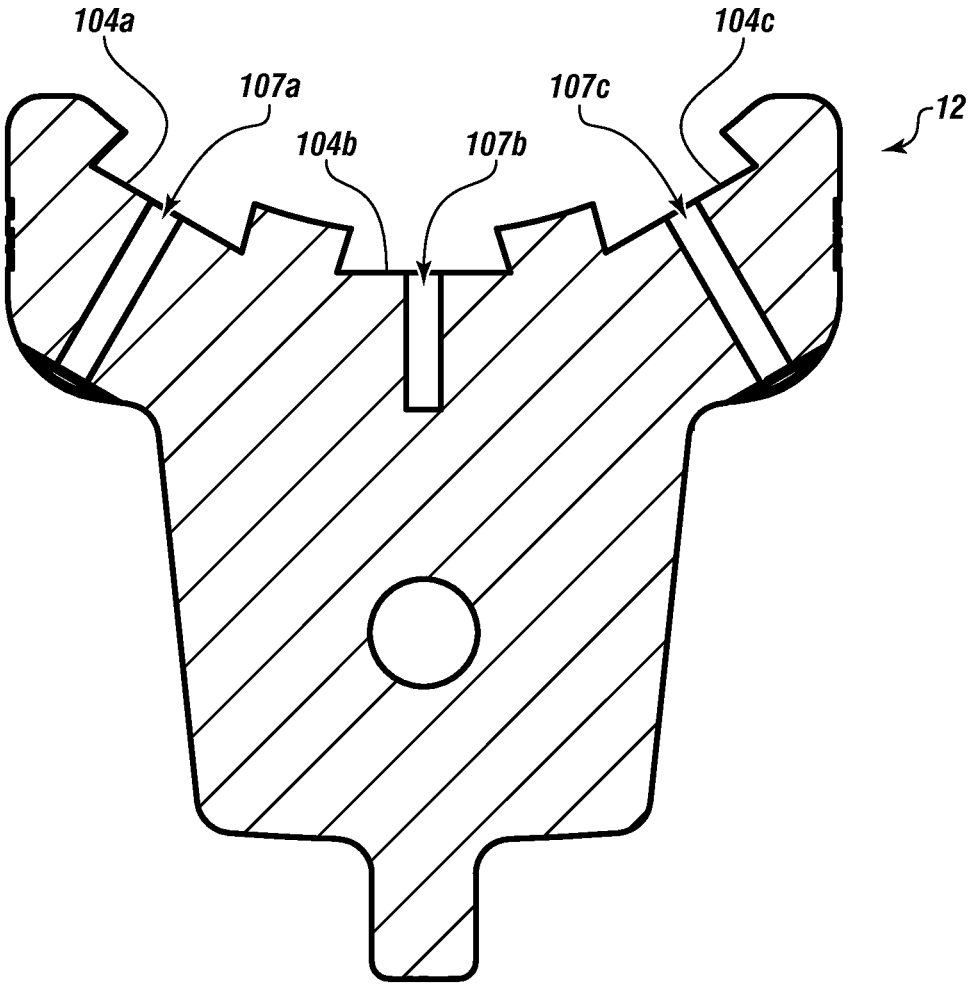
FIG. 3 depicts a cross sectional view of another embodiment of the floating jaw.

FIG. 3 depicts a cross sectional view of another embodiment of the floating jaw.

The floating jaw 12 can have three parallel floating tong die grooves 104*a*, 104*b*, and 104*c*, which can each slidably receive and supports a tong die.

Each parallel floating tong die groove 104*a*-104*c* can have a compression means, such as detents 107*a*, 107*b*, and 107*c*. The detents 107*a*-107*c* can hold the tong dies within the parallel floating tong die groove 104*a*-104*c* and between the sloped groove edges thereof.

Figure 4:
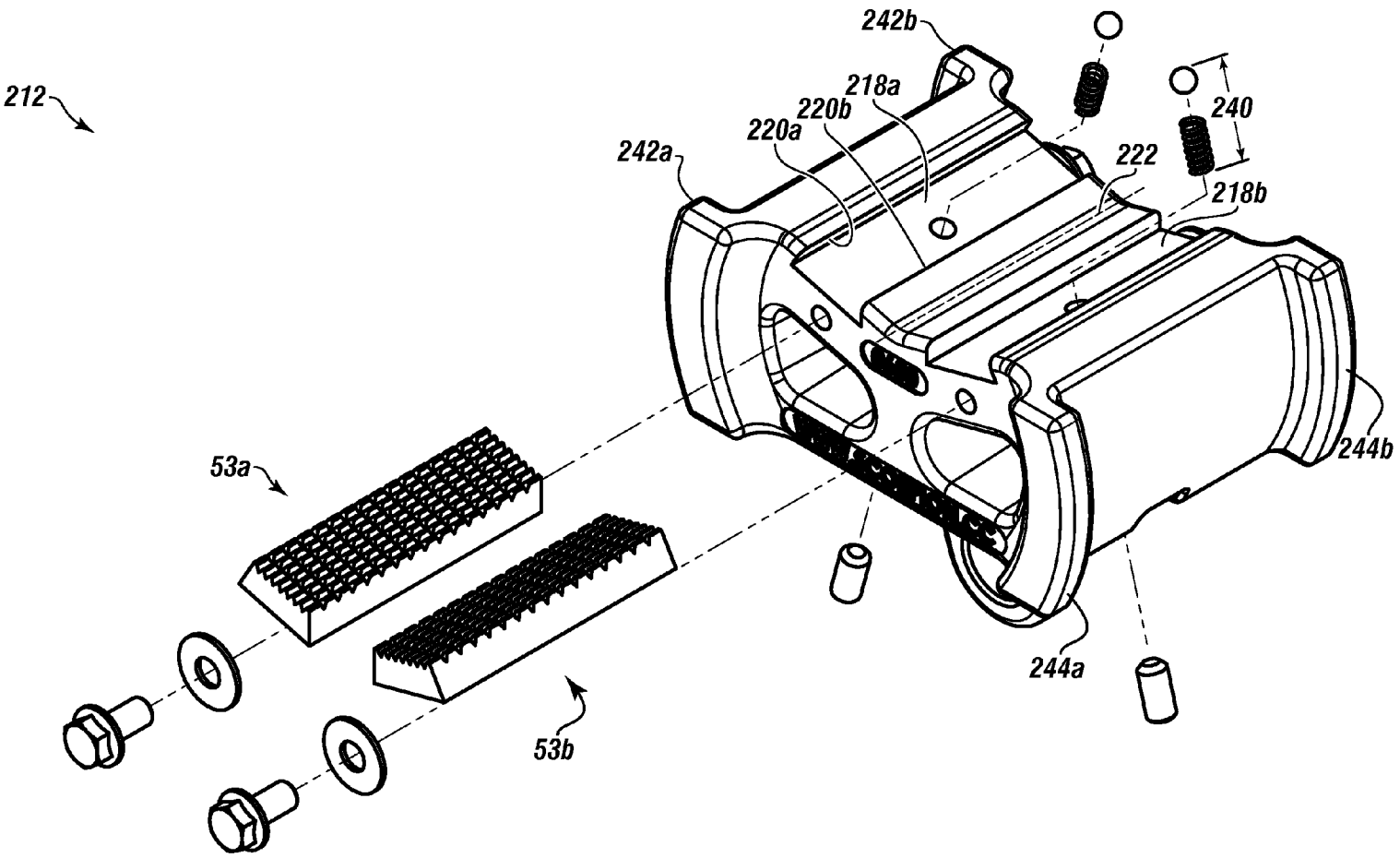
FIG. 4 depicts an exploded perspective view of a moveable jaw according to one or more embodiments.

FIG. 4 depicts an exploded perspective view of the moveable jaw 212 according to one or more embodiments.

The moveable jaw 212 can have a moveable jaw top face 222 with a pair of moveable tong die grooves 218*a* and 218*b* formed therein.

A pair of tong die lips can be formed on each moveable tong die groove 218*a* and 218*b*. For example, tong die lips 220*a* and 220*b* can be formed on moveable tong die groove 218*a*. The tong die lips 220*a* and 220*b* can slope inwardly for retaining the opposite tong dies 53*a* and 53*b*.

The moveable jaw 212 can have a first pair of moveable jaw side flanges 244*a* and 244*b* and a second pair of moveable jaw side flanges 242*a* and 242*b*. The moveable jaw side flanges

244*a* and 244*b*, and 242*a* and 242*b* can provide a secure connection with the inner recess of the curved frame.

The moveable jaw 212 can have one or more compression means 240 for the opposite tong dies 53*a* and 53*b* for applying pressure to the opposite tong dies 53*a* and 53*b* disposed within the moveable jaw tong die grooves 218*a* and 218*b*.

Figure 5:
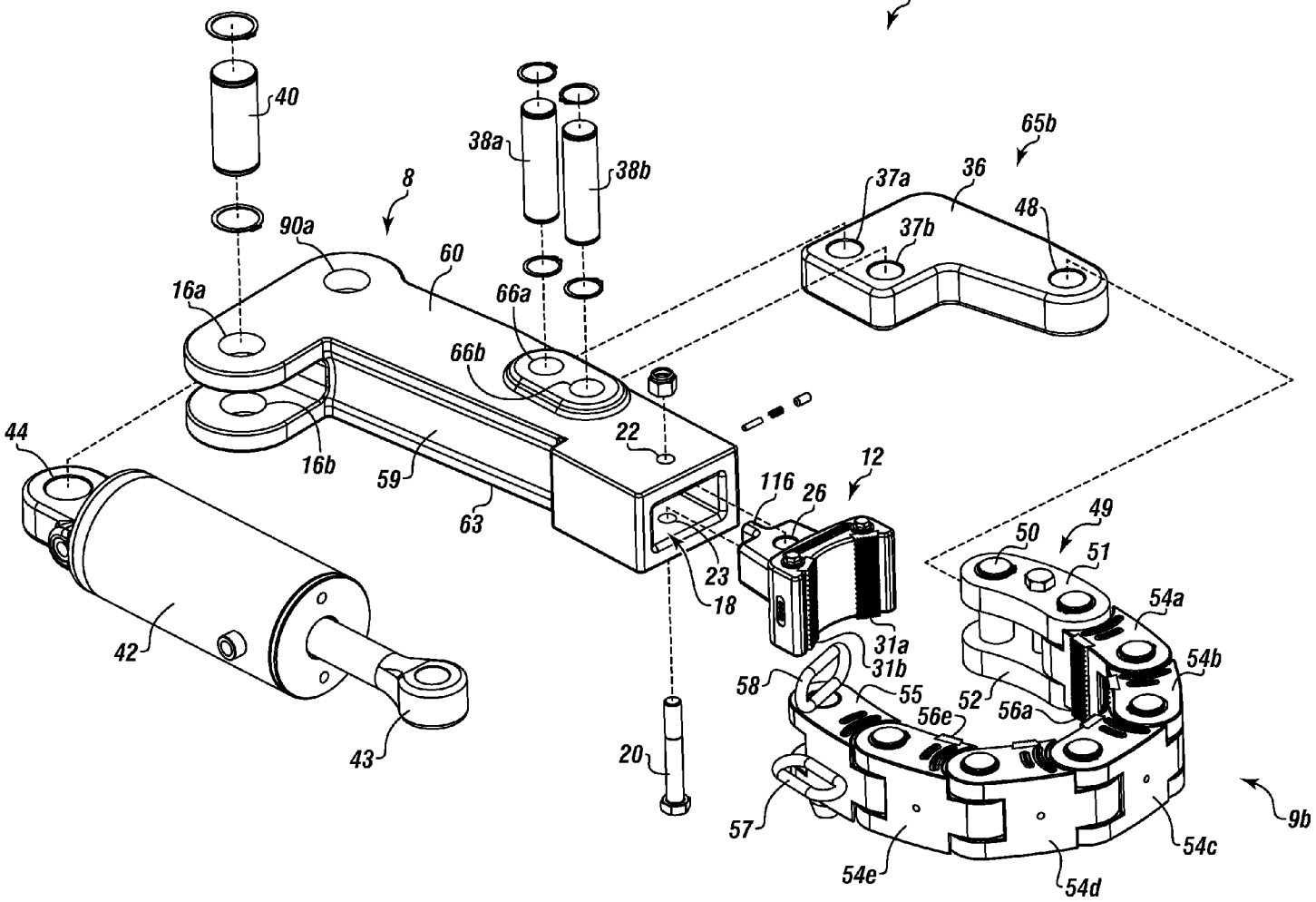
FIG. 5 depicts an exploded perspective view of the tong arm assembly according to one or more embodiments.

FIG. 5 depicts an exploded perspective view of the tong arm assembly 7*b* according one or more embodiments.

The tong arm assembly 7*b* can include the arm frame 8 having the recess 18, the gripping cylinder holes 16*a* and 16*b*, the makeup/breakout cylinder holes 90*a*, the first recess hole 22, the second recess hole 23, the link attachment holes 66*a* and 66*b*, the top plate 60, the bottom plate 63, and the side support plate 59.

The tong arm assembly 7*b* can include the gripping cylinder 42 with the moveable rod 43 and the gripping cylinder tail hole 44. The gripping cylinder 42 can be fixedly but removably secured to the arm frame 8 via the cylinder fastener 40 engaging through the gripping cylinder tail hole 44 and the gripping cylinder holes 16*a* and 16*b*.

The tong arm assembly 7*b* can include floating jaw 12 partially disposed within the recess 18 and secured to the arm frame 8 via the first fastener 20 extending through the first recess hole 22, the second recess hole 23, and the tail hole 26. The floating jaw tail extension 116 can extend into the recess 18.

The floating jaw 12 can have one or more tong dies 31*a* and 31*b* slidably and removably attached to the floating jaw 12 opposite the recess 18.

The tong arm assembly 7*b* can include a counter gripping member 9*b* connected on one end to the moveable rod 43 and on the opposite end with an embodiment of the multi-function L-link assembly 65*b*.

A locking link 55 of the counter gripping member 9*b* can be connected in series with a plurality of chain links 54*a*, 54*b*, 54*c*, 54*d*, and 54*e*. The pin tee 58 can be secured through the locking link 55 and the moveable rod 43 for connecting the counter gripping member 9*b* thereto.

A handle 57 can be attached to the locking link 55, and can allow for lifting or lowering of the locking link 55.

The plurality of chain links 54*a*-54*e* can be connected in series to a connecting link assembly 49 of the counter gripping member 9*b* opposite the movable rod 43. The connecting link assembly 49 can have a top link plate 51 and a bottom link plate 52 connected by a pivot post 50.

The pivot post 50 can also engage through a pivot hole 48 of the multi-function L-link assembly 65*b* for connecting the counter gripping member 9*b* thereto.

The pivot hole 48 can be formed through an L-member 36 of the multi-function L-link assembly 65*b*.

The L-member 36 can have L-member fastening holes 37*a* and 37*b* for fastening the L-member 36 to the arm frame 8 via the link pins 38*a* and 38*b* and the link attachment holes 66*a* and 66*b*.

Each chain link 54*a*-54*e* can support one or more chain link opposite tong dies, such as chain link opposite tong dies 56*a*-56*e*.

In operation, the chain links 54*a*-54*e* can easily slip over the outer perimeter of a tubular, such as a tubular having an uneven outer diameter.

The chain links 54*a*-54*e* can flexibly and moveably connect around the tubular while the moveable rod 43 is in an extended position.

Torque can be applied to the tubular by retracting the moveable rod 43 into the gripping cylinder 42. The chain link opposite tong dies 56*a*-56*e* can engage and grip the tubular, and the chain links 54*a*-54*e* can tighten around the tubular. The tong dies 31*a* and 31*b* and the chain link opposite tong dies 56*a*-56*e* can grip the tubular, allowing for making up or breaking out of the tubular.

Figure 6:
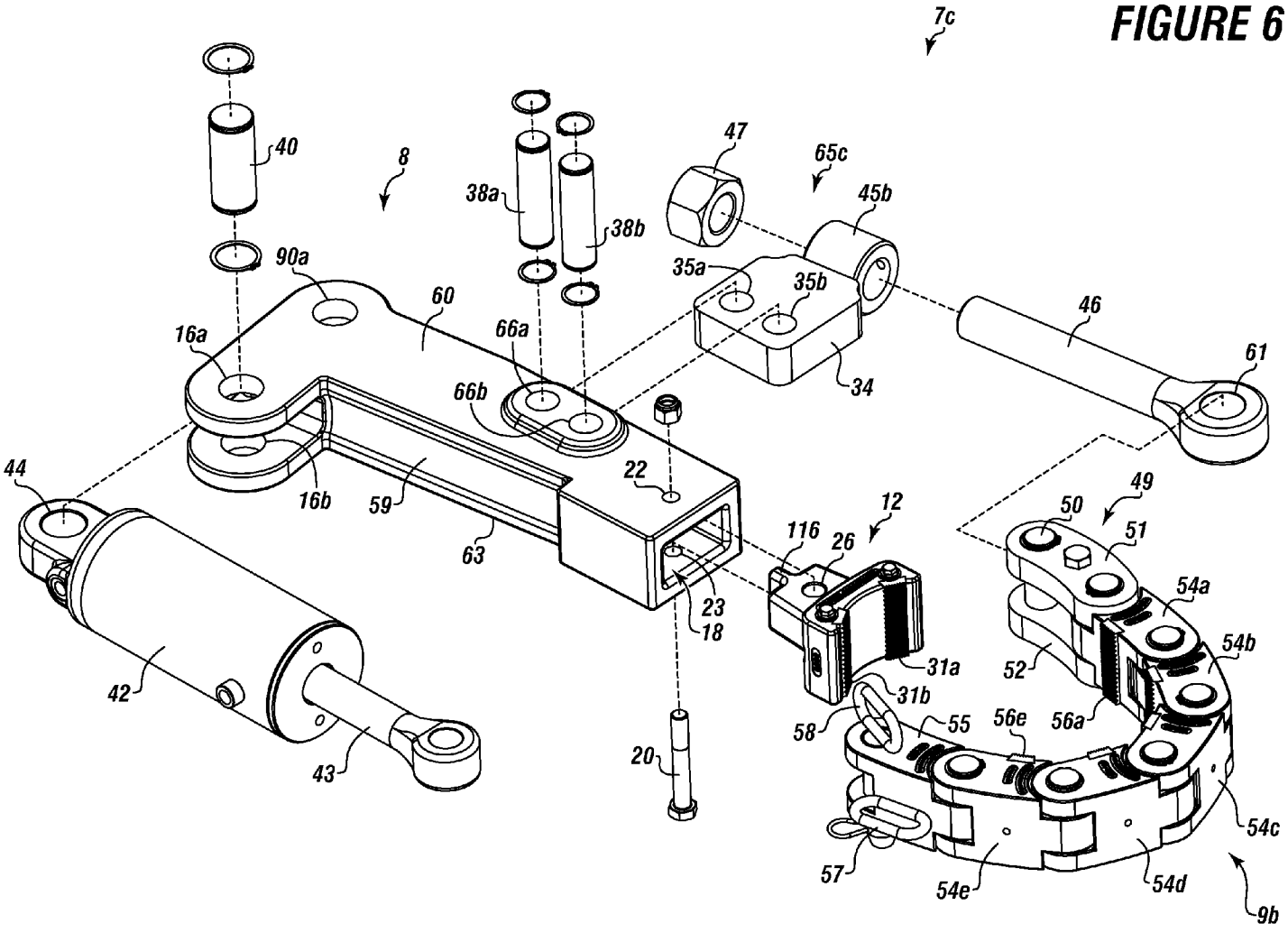
FIG. 6 depicts an exploded perspective view of another embodiment of the tong arm assembly.

FIG. 6 depicts an exploded perspective view of the tong arm assembly 7*c* according to one or more embodiments.

The tong arm assembly 7*c* can include the arm frame 8 having the recess 18, the gripping cylinder holes 16*a* and 16*b*, the makeup/breakout cylinder holes 90*a*, the first recess hole 22, the second recess hole 23, the link attachment holes 66*a* and 66*b*, the top plate 60, the bottom plate 63, and the side support plate 59.

The tong arm assembly 7*c* can include the gripping cylinder 42 with the moveable rod 43 and the gripping cylinder tail hole 44. The gripping cylinder 42 can be fixedly but removably secured to the arm frame 8 via the cylinder fastener 40 engaging through the gripping cylinder tail hole 44 and the gripping cylinder holes 16*a* and 16*b*.

The tong arm assembly 7*c* can include floating jaw 12 partially disposed within the recess 18 and secured to the arm frame 8 via the first fastener 20 extending through the first recess hole 22, the second recess hole 23, and the tail hole 26. The floating jaw tail extension 116 can extend into the recess 18.

The floating jaw 12 can have one or more tong dies 31*a* and 31*b* slidably and removably attached to the floating jaw 12 opposite the recess 18.

The tong arm assembly 7*b* can include the counter gripping member 9*b* connected on one end to the moveable rod 43 and on the opposite end with an embodiment of the multi-function L-link assembly 65*c*.

The counter gripping member 9*b* can include the locking link 55, the plurality of chain links 54*a*-54*e*, the pin tee 58, the handle 57, the connecting link assembly 49 with the top link plate 51, the bottom link plate 52, and the pivot post 50.

The pivot post 50 can engage through the eyebolt hole 61 of the eyebolt 46.

The multi-function L-link assembly 65*c* can include a connecting member 34 with a collar 45*b*.

The eyebolt 46 can be secured within the collar 45*b* via the nut 47.

The connecting member 34 can have connecting member fastening holes 35*a* and 35*b* for fastening the connecting member 34 to the arm frame 8 via the link pins 38*a* and 38*b*.

In operation of the tong arm assembly 7*c*, the chain links 54*a*-54*e* can easily slip over tubulars, such as tubulars with uneven outer diameters, and can flexibly and moveably connect around the tubulars while the moveable rod 43 is in an extended position. When torque is applied to tighten the chain links 54*a*-54*e* around the tubulars and the moveable rod 43 is retracted into the gripping cylinder 42, the tong dies 31*a* and 31*b* and the chain links opposite tong dies 56*a*-56*e* can grip the tubulars. As such, torque is applied to the tubulars, allowing for making up or breaking out of the tubulars.

Figure 7:
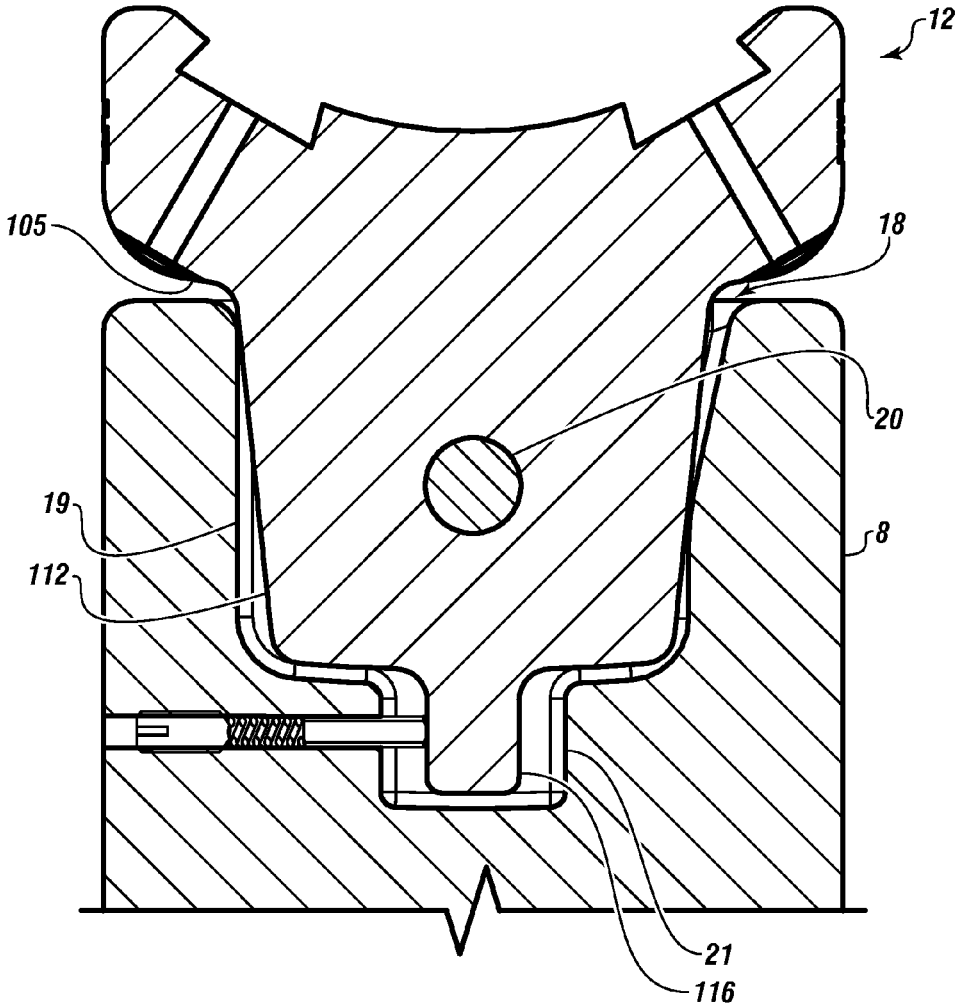
FIG. 7 depicts a cross sectional view of the floating jaw of FIG. 2A engaged in an arm frame.

FIG. 7 depicts a cross sectional view of the floating jaw shown in FIG. 2A engaged in the arm frame.

The recess 18 can have a large opening 19 and a small opening 21 contiguous with the large opening 19.

The large opening 19 can have an area that is larger than the floating jaw tail 112, allowing for lateral, and side-to-side movement of the floating jaw tail 112 within the large opening 19.

The recess holes of the arm frame 8 can open into the large opening 19, through which the first fastener 20 can pass for holding the floating jaw tail 112 within the large opening 19. As such, the floating jaw tail 112 can rock about the first fastener 20 when the curved rocking shoulder 105 of the floating jaw 12 moves on the recess face.

The small opening 21 can have an area and width that is larger than the floating jaw tail extension 116, allowing for rocking movement of the floating jaw tail extension 116 in the small opening 21.

In one or more embodiments, a recess detent, not shown, can be mounted in the arm frame 8 for applying compression to the floating jaw tail extension 116 within the recess 18 for resetting the floating jaw 12 to a load free position.

The shape of the floating jaw tail 112 and the floating jaw tail extension 116 with the curved rocking shoulder 105 resting on the recess face, in addition to the movement permitted in the large opening 19 and the small opening 21, can compensate for any rolling motion of a tubular away from the tong dies.

FIG. 8 depicts a detailed cross sectional view of a tong die with teeth usable on the floating jaw, movable jaw, or both.

The tong die 31*a* can have one or more teeth 110*a* and 110*h*.

The tong die 31*a* can have sloped sides 111*a* and 111*b*. The sloped sides 111*a* and 111*b* can be at angles 113*a* and angle 113*b* away from a vertical.

FIG. 9 depicts a detailed cross sectional view of teeth of a tong die usable on the floating jaw, moveable jaw, or both.

The tong die 31*b* can have teeth having flat faces 115*a* and 115*p*.

The teeth can be supported on a base 121, which can be made of a different material than the teeth.

A cut 198 can be disposed in the tong die 31*b* opposite the teeth, and can be configured to receive a detent or ball, which can be pushed via a spring for holding the tong die 31*b* in the tong die groove.

Figure 10:
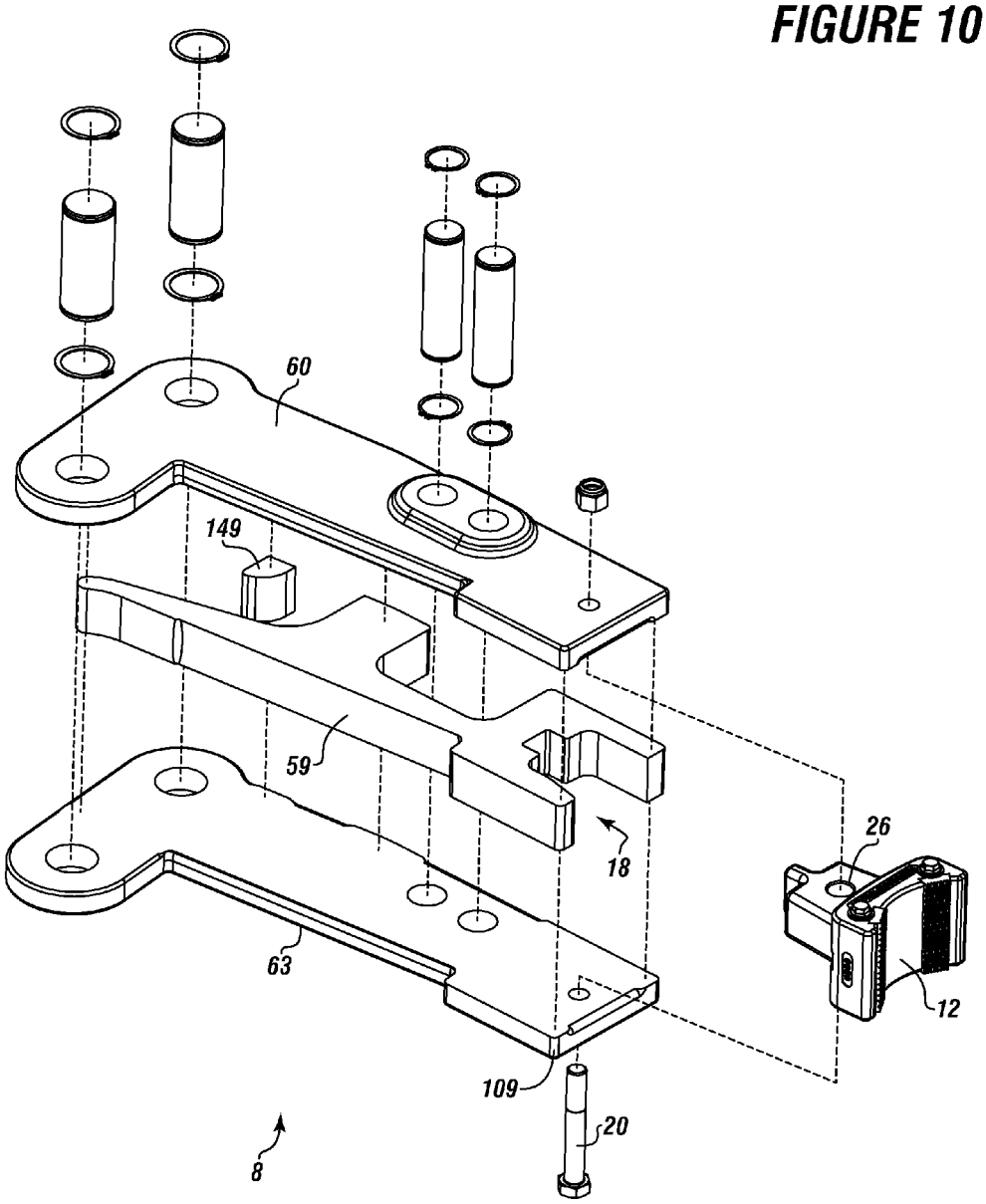
FIG. 10 depicts an exploded perspective view of the arm frame according to one or more embodiments.

FIG. 10 is an exploded perspective view of an arm frame 8 according to one or more embodiments.

The side support plate 59 can be positioned between the top plate 60 and the bottom plate 63. The side support plate 59 can be contained within outer edges of the top plate 60 and the bottom plate 63.

The arm frame 8 can include one or more additional supports 149 disposed between the top plate 60 and the bottom plate 63.

The side support plate 59 can have the recess 18 formed therein, between the top plate 60 and the bottom plate 63. The recess 18 can be configured to receive and contain the floating jaw tail and the floating jaw tail extension of floating jaw 12. The first fastener 20 can extend through the tail hole 26 for securing the floating jaw 12.

The recess face 109 can be formed into the top plate 60 and the bottom plate 63.

While these embodiments have been described with emphasis on the embodiments, it should be understood that within the scope of the appended claims, the embodiments might be practiced other than as specifically described herein.

What is claimed is:

1. A tong arm assembly configured to engage a tubular, the tong arm assembly comprising:

a. an arm frame with a recess, gripping cylinder holes, and a makeup/breakout cylinder hole;

b. a floating jaw partially disposed within the recess and securable to the arm frame, wherein the floating jaw has at least one tong die slidably and removably attached thereto opposite the recess;

c. a gripping cylinder with a moveable rod extending therefrom, wherein the gripping cylinder is secured to the arm frame via a cylinder fastener and the gripping cylinder holes, and wherein the gripping cylinder nests adjacent to the arm frame and extends longitudinally along the arm frame;

d. a counter gripping member connected on one end to the moveable rod, wherein at least one opposite tong die is disposed on the counter gripping member opposite the at least one tong die of the floating jaw; and e. a multi-function L-link assembly engaging the counter gripping member and the arm frame, wherein the multi-function L-link assembly comprises a first L-link fixedly engaged to the arm frame on a side opposite the gripping cylinder, and an eyebolt that engages the first L-link on one end and the counter gripping member on an opposite end, and wherein the multi-function L-link assembly further comprises a collar extending from a first L-link body opposite first link fastening holes, wherein the eyebolt is secured within the collar on one end and engaged with an engagement post; and a nut removably attaching the eyebolt into the collar, wherein the first link fastening holes each receive a link pin to secure the multi-function L-link assembly to the arm frame, wherein the counter gripping member connects around the tubular while the moveable rod is in an extended position, and wherein the tong arm assembly consistently applies torque around the tubular when the moveable rod is retracted into the gripping cylinder, thereby causing each tong die and opposite tong die to touch and grip the tubular on an outer diameter for making up or breaking out the tubular.

2. The tong arm assembly of claim 1, wherein the floating jaw comprises:

a. a floating jaw body having a curved rocking shoulder that allows the floating jaw body to float and rock on the arm frame above the recess;

b. a face formed on a first side of the floating jaw body;

c. at least one tong die groove formed in the face, wherein each tong die groove has a pair of sloped groove edges;

d. a floating jaw tail extending from the floating jaw body opposite the face, wherein the floating jaw tail has a tail hole;

e. a floating jaw tail extension extending from the floating jaw tail, wherein a width of the floating jaw body is larger than a width of the floating jaw tail, and wherein a length of the floating jaw body is larger than a length of the floating jaw tail; and f. a first fastener engaged through the tail hole and retaining the floating jaw tail within the recess.

3. The tong arm assembly of claim 2, wherein the face has three parallel floating jaw tong die grooves, wherein the parallel floating jaw tong die grooves support tong dies, and wherein each tong die in the parallel floating jaw tong die grooves is held in place with a detent.

4. The tong arm assembly of claim 2, wherein the arm frame further comprises a first recess hole and a second recess hole aligned with the first recess hole, wherein the first fastener passes through the first recess hole, through the tail hole, and into the second recess hole and pivotably holds the floating jaw in the recess.

5. The tong arm assembly of claim 2, wherein the recess further comprises:

a. a large opening with an area larger than the floating jaw tail, wherein the large opening allows movement of the floating jaw tail therein;

b. a first recess hole aligned with a second recess hole, wherein the first recess hole and the second recess hole open into the large opening, and wherein the tail hole is aligned with the first recess hole and the second recess hole via a first fastener, thereby allowing the floating jaw tail to rock about the first fastener in the large opening;

c. a small opening contiguous with the large opening, wherein the small opening has a width wider than the floating jaw tail extension, allowing rocking movement of the floating jaw tail extension in the small opening; and d. a recess detent mounted in the arm frame for applying compression to the floating jaw tail extension within the recess to reset the floating jaw to a load-free position, wherein a rolling motion by the tubular away from each tong die is compensated by: a shape of the floating jaw tail, a shape of the floating jaw tail extension, the curved rocking shoulder resting on a recess face of the recess, and movement permitted in the large opening and the small opening.

6. The tong arm assembly of claim 1, wherein the counter gripping member comprises:

a. a curved frame;

b. an inner recess positioned directly opposite the floating jaw;

c. an engagement post removably secured to one end of the curved frame;

d. a pin tee secured through an opposite end of the curved frame, wherein the pin tee engages the moveable rod; and e. a moveable jaw positioned opposite the floating jaw.

7. The tong arm assembly of claim 6, wherein the counter gripping member further comprises:

a. at least one lifting slot; and b. at least one storage hole for receiving the pin tee when disconnected from the moveable rod.

8. The tong arm assembly of claim 6, wherein the moveable jaw comprises:

a. a moveable jaw top face;

b. a pair of moveable tong die grooves formed in the moveable jaw top face;

c. a pair of tong die lips that are sloped to retain moveable jaw tong dies in each moveable tong die groove;

d. a first pair of moveable jaw side flanges and a second pair of moveable jaw side flanges, wherein the moveable jaw side flanges provide a secure connection with the inner recess; and e. a compression means for applying pressure to the moveable jaw tong dies disposed within the moveable jaw tong die grooves.

9. The tong arm assembly of claim 1, wherein the counter gripping member comprises:

a. a connecting link assembly with a top link plate and a bottom link plate connected by a pivot post;

b. a plurality of chain links connected in series to the connecting link assembly;

c. a locking link connected in series with the plurality of chain links for engaging the moveable rod;

d. at least two chain link opposing tong dies, wherein a first chain link opposing tong die is attached to a first chain link and a second chain link opposing die tong is attached to a second chain link spaced apart from the first chain link, and wherein both chain link opposing tong dies are opposite the floating jaw; and e. an L-member with a pivot hole for restraining the pivot post and L-member fastening holes for fastening the L-member to the arm frame via link pins, wherein the chain links are configured to slip over uneven outer diameters to flexibly and moveably connect around the tubular while the moveable rod is in an extended position, and wherein when torque is applied to tighten the chain links around the tubular when the moveable rod is retracted into the gripping cylinder, each tong die on the chain links grip the tubular opposite the tong dies of the floating jaw, thereby allowing making up or breaking out of the tubular.

10. The tong arm assembly of claim 9, further comprising a handle attached to the locking link.

11. The tong arm assembly of claim 1, wherein the arm frame further comprises a side support plate connected between a top plate and a bottom plate.

12. The tong arm assembly of claim 1, wherein the counter gripping member comprises:

a. a connecting link assembly with a top link plate and a bottom link plate connected by a pivot post;

b. a plurality of chain links connected in series to the connecting link assembly;

c. a locking link connected in series with the chain links for engaging the moveable rod with a pin tee;

d. at least two chain link opposing tong dies, wherein a first chain link opposing tong die is attached to a first chain link and a second chain link opposing die is attached to a second chain link that is spaced apart from the first chain link, and wherein both chain link opposing tong dies are opposite the floating jaw; and e. a connecting member comprising:

(i) a collar;

(ii) an eyebolt secured within the collar via a nut, wherein the eyebolt engages the pivot post; and (iii) connecting member fastening holes for fastening the connecting member to the arm frame with link pins, wherein the chain links are configured to slip over uneven outer diameters and flexibly and moveably connect around the tubular while the moveable rod is in an extended position, and wherein when torque is applied to tighten the chain links around the tubular when the moveable rod is retracted into the gripping cylinder, each tong die on the chain links grip the tubular opposite the tong dies of the floating jaw, thereby allowing making up or breaking out of the tubular.

* * * * *